US008628260B2

(12) United States Patent
Dewey

(10) Patent No.: US 8,628,260 B2
(45) Date of Patent: Jan. 14, 2014

(54) CARRIAGE SUPPORT MEMBER

(75) Inventor: Jason S. Dewey, San Diego, CA (US)

(73) Assignee: Kodak Alaris Inc., Rochester, NY (US)

( * ) Notice: Subject to any disclaimer, the term of this patent is extended or adjusted under 35 U.S.C. 154(b) by 1047 days.

(21) Appl. No.: 12/100,550

(22) Filed: Apr. 10, 2008

(65) Prior Publication Data

US 2009/0257806 A1 Oct. 15, 2009

(51) Int. Cl.
*B41J 11/22* (2006.01)

(52) U.S. Cl.
USPC ..... 400/354; 400/283; 400/352

(58) Field of Classification Search
USPC ..... 400/354, 353, 354.2, 354.3, 355, 283; 347/8, 37, 104
See application file for complete search history.

(56) References Cited

U.S. PATENT DOCUMENTS

| | | | | |
|---|---|---|---|---|
| 5,940,092 | A * | 8/1999 | Kashimura et al. | 347/8 |
| 6,082,854 | A | 7/2000 | Axtell et al. | 7/108 |
| 6,231,160 | B1 | 5/2001 | Glass | 347/40 |
| 6,520,622 | B1 | 2/2003 | Yusef et al. | 347/37 |
| 2004/0056911 | A1 | 3/2004 | Fairchild et al. | 347/8 |

FOREIGN PATENT DOCUMENTS

| | | | | |
|---|---|---|---|---|
| EP | 0 827 839 | A1 | 3/1998 | B41J 2/51 |
| EP | 0 983 862 | A2 | 3/2000 | B41J 25/308 |
| JP | 2000351249 | A | 12/2000 | B41J 25/304 |

* cited by examiner

*Primary Examiner* — Jill Culler
*Assistant Examiner* — Marissa Ferguson Samreth
(74) *Attorney, Agent, or Firm* — Hogan Lovells US LLP

(57) ABSTRACT

A carriage support member for an inkjet printer printhead carriage includes a bar shaped structure with a first contact area and a second contact area. A pivotable carriage attachment is located between the first contact area and the second contact area. The first contact area and the second contact area slide or roll along the secondary guide rail. The carriage is attached to the carriage attachment. The bar shaped structure pivots relative to the carriage by the carriage attachment.

14 Claims, 9 Drawing Sheets

CARRIAGE SUPPORT MEMBER

FIELD OF THE INVENTION

The invention relates generally to the field of printers and, in particular, to an apparatus to minimize print quality defects caused by carriage rail defects.

BACKGROUND OF THE INVENTION

An imaging apparatus can either form the image or read the image or a combination thereof. An image reading apparatus can include a scanner, a spectrophotometer and the like wherein an already formed image is read by the apparatus. An image forming apparatus can include a printer or other graphic arts apparatus. In an imaging apparatus, the component which forms the image or reads the image can be affected by the distance to the image and the way such image is read or formed.

For example, typical printers include inkjet printing systems having a printhead with a plurality of orifices or nozzles, an ink supply which feeds ink to at least one inkjet printhead located on a printhead carriage, and an electronic controller. The printhead carriage passes back and forth over the media supported by a platen selectively depositing ink through its nozzles on the media.

In an imaging apparatus such as an inkjet printer, print quality is highly dependent on accurate ink droplet placement on the print media. Droplet placement accuracy is required to provide minimal graininess and banding, maximum sharpness, line acuity and smoothness. The accuracy of the droplet placement depends on several factors such as consistent spacing between the printhead nozzle and the media over the full length and breadth of the printer platen, especially in bi-directional printing. Deviations in this spacing affect the ink droplet flight time resulting in inaccurate drop placement, and thus reduce image quality.

One source of printhead nozzle and media spacing variation can arise from printhead carriage guide rails with an unacceptable straightness or defect. The primary guide rail for a printhead carriage is typically made with tight tolerances to attempt to maintain a precise and consistent spacing between the printhead and the print media. The secondary guide rail, or anti-rotation rail, can consist of bent sheet metal, in order to decrease the expense of providing expensive pre-straightened rails. In some applications the secondary guide rail can be a discrete elongated member that is mechanically attached to a support structure of the printer. In other applications the secondary guide "rail" may not be a separate part, but can in fact consist of a guide surface on an elongated part of the printer which is spaced apart from the primary guide rail. The terms "secondary guide rail" and "secondary guide surface" will be used interchangeably herein to refer to either type of structure.

Guide rails are more difficult and expensive to produce with adequate straightness in larger printers, such as a wide format inkjet printer, due to their larger size, such as 24 inches or 44 inches wide or wider. In a wide format inkjet printer, waviness in the secondary guide rail can be due to manufacturing processes or can be due to stresses arising from the mechanical attachment of the secondary guide rail to the printer. Such waviness can be cyclic—i.e. there can be recurring peaks and valleys where the peak to peak distance can be described by a wavelength. Dents or defects due to manufacturing and mishandling of the rail produce non-cyclic or single defects in the secondary guide rail.

As the carriage and printhead pass over the various defects, the spacing between the printhead nozzle and the media is affected resulting in inaccurate drop placement, and thus reduce image quality.

In the prior art, a single point of contact is provided between the carriage and the secondary or anti-rotation rail to minimize print defects. For example, U.S. Pat. No. 6,082,854, issued to Axtell et al. discloses a carriage adapted for riding on an anti-rotation rod which acts like an anti-rotation rail and a slider bar which acts like a primary guide rail. A single idler wheel rides atop the anti-rotation rod.

Additionally, U.S. Pat. No. 6,231,160, issued to Glass discloses a pair of bearings that slidably support the carriage on a slider rod, which acts as a primary guide rail. A slide bushing is attached to the rear wall of the carriage. The slide bushing engages an anti-rotation guide bar, which acts like an anti-rotation rail.

U.S. Pat. No. 6,520,622, issued to Yusef et al. discloses a wear device that provides a contact or anti-rotation surface that slidably interacts with the support surface of the anti-rotation rail.

SUMMARY OF THE INVENTION

It is therefore a feature of the present invention to provide a carriage support member that is simple in structure and provides two points of contact between the carriage support member and the anti-rotation rail to minimize print defects caused by printhead carriage rail defects.

Furthermore, it is a feature of the present invention to provide an economical carriage support member that aids in ensuring the carriage is in the proper position as it traverses above the print media.

According to one aspect of the invention, a carriage support member to minimize print defects caused by printhead carriage rail defects and which supports a carriage that moves along a primary guide rail and a secondary guide rail includes a bar shaped structure with a first contact area and a second contact area. A carriage attachment is located between the first contact area and the second contact area. The first contact area and the second contact area move along the secondary guide rail. The carriage support member is pivotable about the carriage attachment.

Another aspect of the present invention provides a carriage support member for supporting a carriage that moves along a primary and secondary guide rail comprising a bar shaped structure with a first contact area and a second contact area. A carriage pivot attachment is located between the first contact area and the second contact area. The first contact area and the second contact area are designed to be spaced apart at a distance determined by the known periodicity of a cyclic defect in the secondary guide rail.

Another aspect of the present invention provides a carriage support member for supporting a carriage that moves along a primary and secondary guide rail comprising a bar shaped structure with a first contact roller and a second contact roller. A carriage pivot attachment is located between the first contact roller and the second contact roller. The first contact roller and the second contact roller roll along the secondary guide rail.

Another aspect of the present invention provides a carriage support member for supporting a carriage that moves along a primary and secondary guide rail comprising a bar shaped structure with a first pivotable flat surface and a second pivotable flat surface. A carriage pivot attachment is located between the first pivotable flat surface and the second pivotable flat surface. The first pivotable flat surface and the second pivotable flat surface are in contact with the secondary guide rail. The first pivotable flat surface and the second pivotable flat surface pivot independently of each other on the bar shaped structures. The bar shaped structure is separately pivotable about the carriage attachment.

Another aspect of the present invention provides an image forming apparatus comprising a primary guide rail and a secondary guide rail. A bar shaped structure includes a first contact area and a second contact area. A carriage attachment is on the bar shaped structure, centrally located between the first contact area and the second contact area. The carriage attachment supports an image forming apparatus carriage. The first contact area and the second contact area move along on the secondary guide rail. The image forming apparatus is a wide format inkjet printer.

Another aspect of the present invention provides a method of compensating against print quality degradation due to defects in an anti-rotation guide, the method comprising providing a primary guide; providing a print head support carriage that is moveable along the primary guide in a direction of travel; providing an anti-rotation guide, including a guide surface having a deviation from straightness, the anti-rotation guide positioned to prevent rotation of the print head support carriage about the primary guide; providing a pivotable support configured to establish two areas of contact between the print head support carriage and the anti-rotation guide and that are separated from each other along the direction, the two areas of contact being substantially parallel to the guide surface of the anti-rotation guide; and causing the print head carriage to move back and forth along the primary guide in the direction of travel.

Additional objectives, features and advantages of the present invention will become apparent from the following description of the preferred embodiments with reference to the attached drawings.

DETAILED DESCRIPTION OF THE INVENTION

Figure 1:
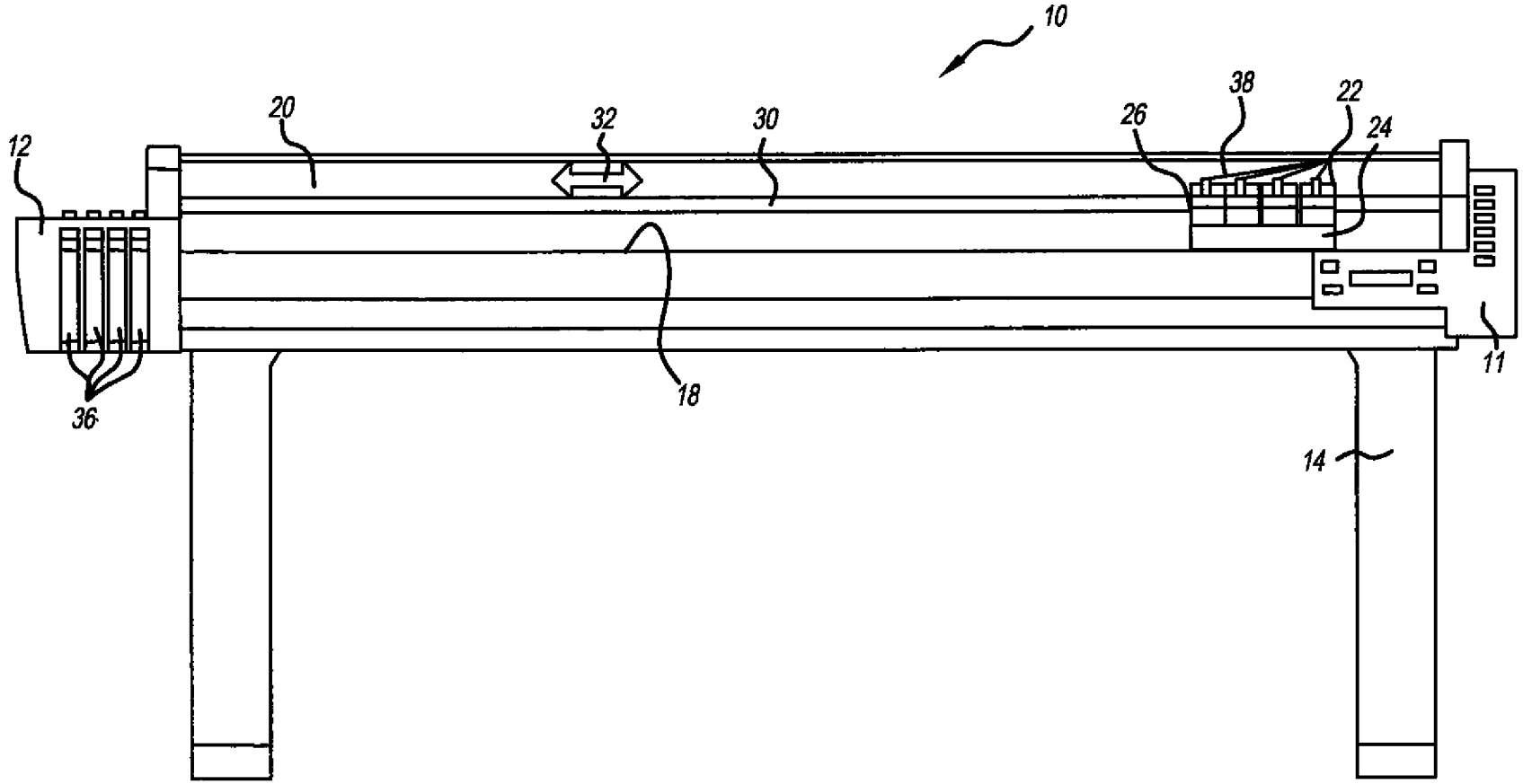
FIG. 1 is a front view of a wide format inkjet printer.

Referring to FIG. 1, one specific embodiment of a large format ink jet printer 10 includes right and left side housings 11, 12, and is supported by a pair of legs 14. The right housing 11, shown in FIG. 1 with a display and keypad for operator input and control, encloses various electrical and mechanical components related to the operation of the printer 10, but is not directly pertinent to the present invention. The left housing 12 encloses ink reservoirs 36 which feed ink to the ink-jet printheads 26 via plastic conduits 38, which run between each ink-jet printhead 26 and each ink reservoir 36. In some printer embodiments, no separate ink reservoirs 36 or tubing 38 is provided, and printing is performed with ink reservoirs integral to the printheads.

Either a roll of continuous print media (not shown) is mounted to a roller on the rear of the printer 10 to enable a continuous supply of paper to be provided to the printer 10 or individual sheets of paper (not shown) are fed into the printer 10. A platen 18 forms a horizontal surface which supports the print media, and printing is performed by select deposition of ink droplets onto the paper. During operation, a continuous supply of paper is guided from the roll of paper mounted to the rear of the printer 10 across the platen 18 by a plurality of upper rollers (not shown) which are spaced along the platen 18. In an alternate usage of printer 10, single sheets of paper or other print media are guided across the platen 18 by the rollers (not shown). A support structure 20 is suspended above the platen 18 and spans its length with sufficient clearance between the platen 18 and the support structure to enable a sheet of paper or other print media which is to be printed on to pass between the platen 18 and the support structure 20.

The support structure 20 supports a print carriage 22 above the platen 18. The print carriage 22 includes a plurality of ink-jet printhead holders 24, and a plurality of replaceable ink-jet printheads 26 mounted therein. In the example shown in FIG. 1, four printheads 26 are mounted in the holders 24 on the print carriage 22, although it is contemplated that any number ink-jet printheads 26 can be provided. The support structure 20 generally comprises a primary guide rail 30 and a secondary guide rail (or secondary guide surface) 35 positioned parallel to the primary guide rail 30. In one embodiment of a wide format inkjet in printer, the primary guide rail 30 is approximately 1860 mm long and the secondary guide rail 35 is approximately 1750 mm long. The print carriage 22 preferably comprises primary support members, such as bushings, e.g. split sleeves which slidably engage the primary guide rail 30 to enable motion of the print carriage 22 along the primary guide rail 30 to define a linear printing path, as shown by the bi-directional arrow 32, along which the print carriage 22 moves. The carriage 22 is slidably attached to the primary guide rail or shaft 30 by two semi-circular primary support members or bushings, 39*a*, 39*b*. The bushings 39*a* and 39*b* are at opposite ends of the carriage 22 and slide over the primary guide rail 30. The weight of the carriage 22 keeps the bushings 39*a*, 39*b* in contact with the top of the shaft 30. A motor and a drive belt mechanism (not shown) are used to drive the print carriage 22 along the primary guide rail 30. The primary guide rail 30 constrains the motion of the print carriage 22 to be along the linear direction 32, but primary guide rail 30 does not constrain the rotation of the print carriage 22 about direction 32. The center of mass of print carriage 22 is not directly above the primary guide rail 30, but is designed to be offset so that the carriage 22 tends to rotate about the primary guide rail 30.

Figure 8:
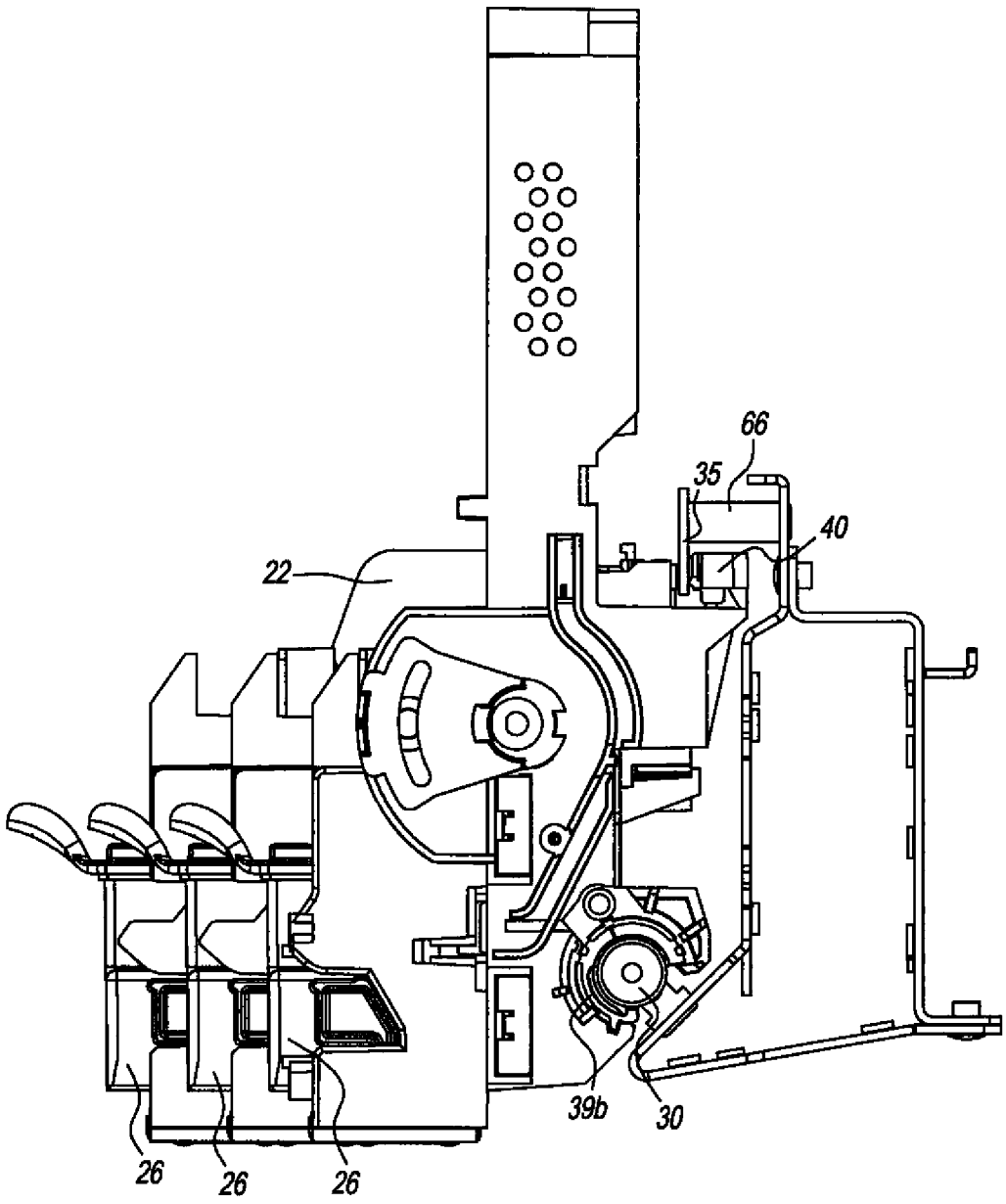
FIG. 8 is a side view of the printhead carriage and the primary and secondary guide rails.
Figure 9:
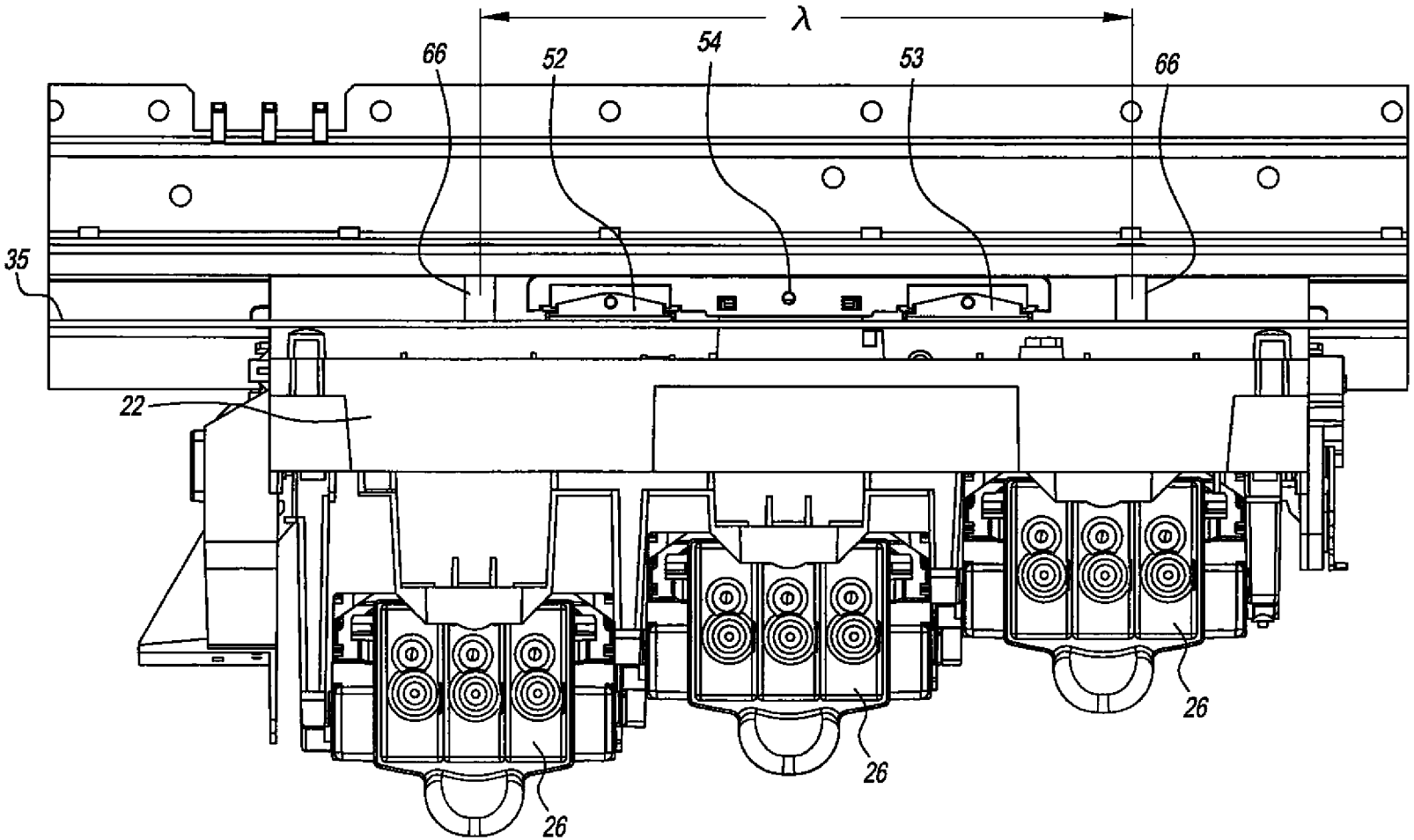
FIG. 9 is a top view of the printhead carriage and the secondary guide rail.

A secondary guide rail 35 is substantially parallel to the primary guide rail 30. The secondary guide rail 35 provides additional support to the print carriage 22 as it moves, and constrains print carriage 22 against rotation about the primary guide rail 30. It is desirable for the guide surface of the secondary guide rail 35 to be spaced apart from primary guide rail 30 a distance S1 that is greater than the distance S2 that the printhead 26 is spaced apart from the primary guide rail 30. The displacement s2 at printhead 26 that is due to a displacement s1 of the carriage at the secondary guide surface 35 is given by s2=s1 (S2/S1). However, other design constraints regarding the size of the printer set an upper limit on the distance S1 between the secondary guide surface 35 and the primary guide rail 30. In a typical example, S1 was chosen to be 60 mm. It was found in this example that the printhead spacing to the paper was still adversely affected by the waviness or deviations from straightness in the secondary guide surface 35. The present invention compensates for such deviations from straightness in the secondary guide surface 35. The primary guide rail 30 is preferably a precision ground shaft. However, the secondary guide rail 35 can be a plate that is joined to the support structure 20 via mechanical fasteners 66 such as nuts and bolts, screws and the like as seen in FIGS. 8 and 9. In the examples of FIGS. 8 and 9 the mechanical fasteners 66 include a standoff, which is a part of a known height and can have internal threads so that a bolt can be screwed into it. In such an example, a series of standoffs 66 are spaced apart by a distance λ. It is found that the secondary guide surface 35 can be bowed between the standoffs 66, so that a wavy surface having peaks and valleys results, wherein the peak to peak distance is λ.

A carriage support member 40 makes contact between the carriage 22 and the secondary guide surface 35. During printing, the carriage 22, supported by the carriage support member 40, passes back and forth along the primary guide rail 30 and the secondary guide rail 35 over the media (not shown). During each pass, the ink jet printheads 26 deposit a swath of ink having a width approximately equal to the width of the ink jet nozzle array of the jet plate on the bottom of the printhead 26. After each pass, the media is incremented, and the carriage 22 is passed back over the media to print the next swath. Depending on the printing mode, the ink jet printheads 26 could print during passes in only one or both directions. Furthermore, in multi-pass print modes, the ink jet printheads can deposit ink over the same location of the media more than once.

Although an ink jet printer is shown, any type of image forming device or method can be used in conjunction with the invention. Further, any type of image reading device or method can be used in conjunction with the invention, such as a scanner or some other measuring device (i.e., color measuring device, spectrophotometer, and the like).

Figure 2:
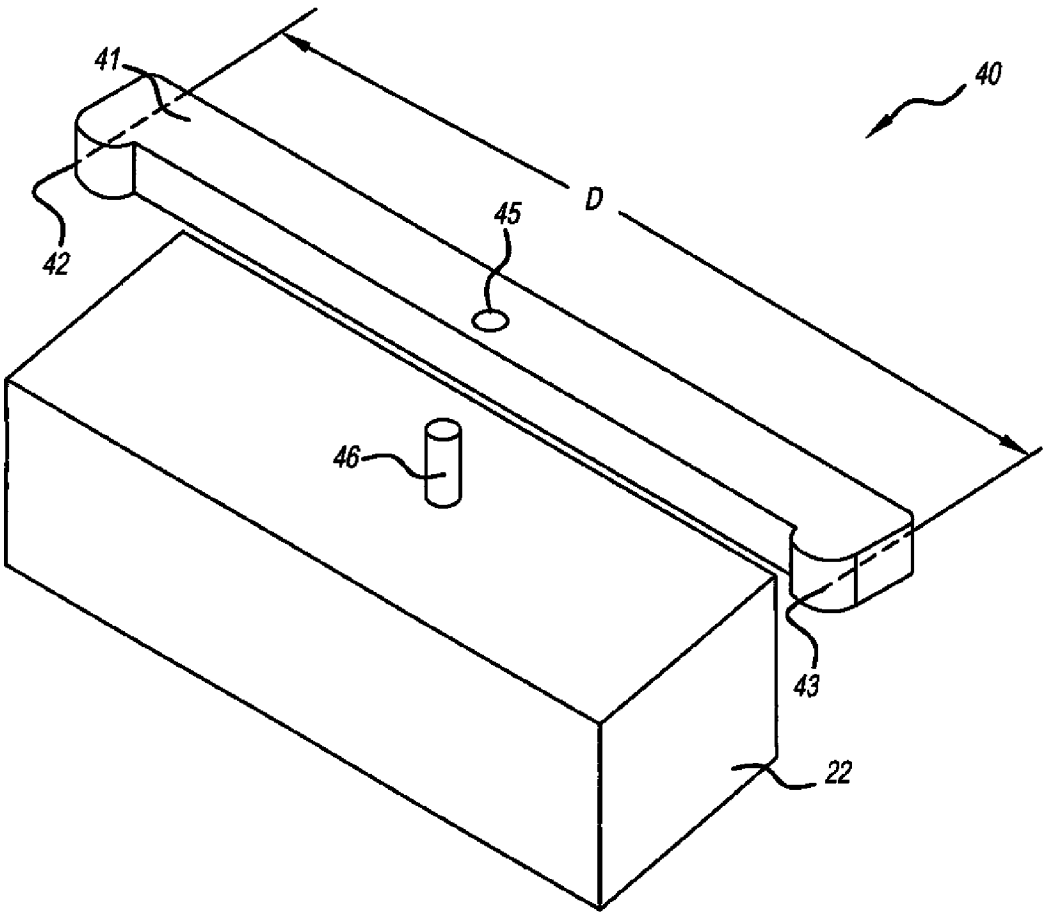
FIG. 2 is a front perspective view of a first embodiment of the carriage support member next to a carriage.
Figure 3:
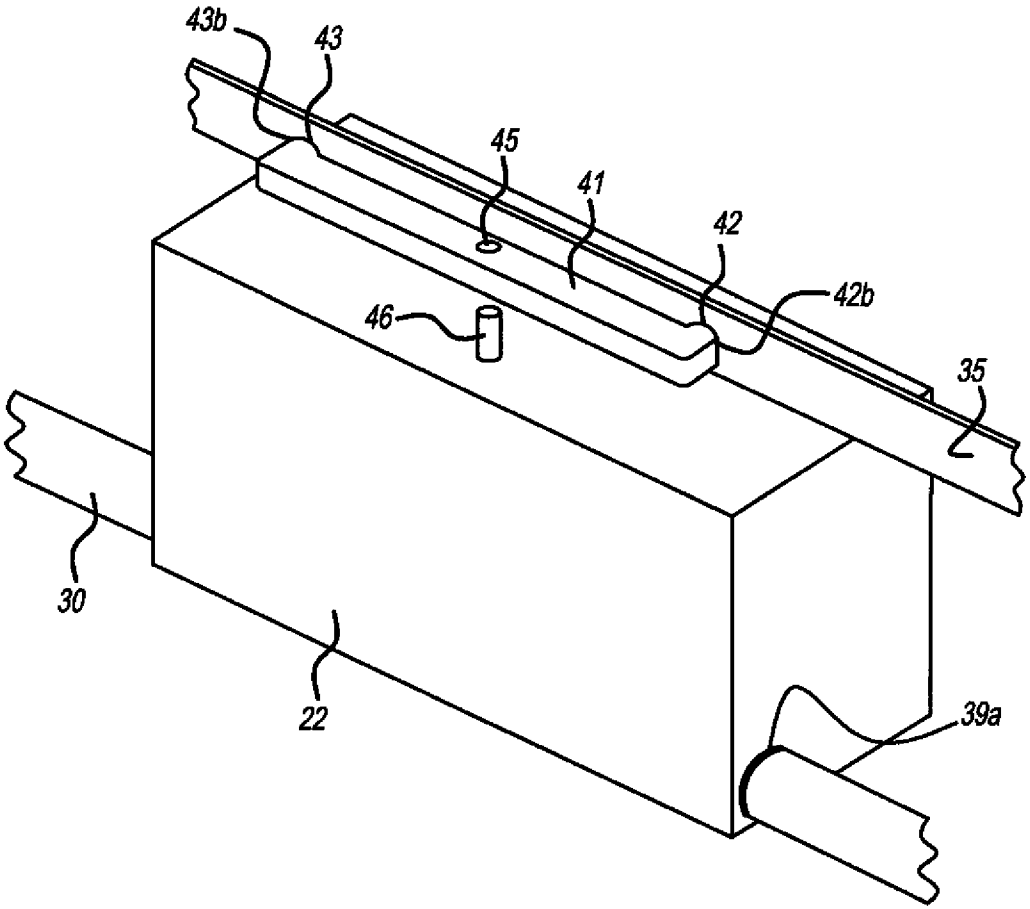
FIG. 3 is a rear perspective view of the carriage support member of FIG. 2 next to a carriage on the primary and secondary guide rails.

FIGS. 2 and 3 demonstrate a first embodiment of the carriage support member 40 for supporting the carriage 22 as it moves along secondary guide rail 35. The carriage support member 40 includes a bar shaped structure 41 made from a material that has low friction and good resistance to wear. An example of such a material is Noryl plastic PPO manufactured by General Electric. However, the bar shaped structure 41 can be manufactured not only from plastics but also other materials such as metals like steel or aluminum. The bar shaped structure 41 has a first protruding contact area 42 and a second protruding contact area 43.

In one embodiment of the invention, the bar shaped structure 41 and the first and second contact areas 42, 43 form a single one piece sliding structure. The first contact area 42 is separated from the second contact area 43 in a direction that is parallel to the length of the secondary guide rail 35. A carriage attachment 44 is located between the first contact area 42 and the second contact area 43. The carriage attachment 44 is positioned between the first contact area 42 and the second contact area 43. Carriage attachment 44 can be centered between first contact area 42 and second contact area 43, but need not to be centered. The bar shaped structure 41 is pivotable about the carriage attachment 44. The carriage 22 attaches to the carriage attachment 44 on the bar shaped structure 41. The carriage attachment 44 can be an orifice such as a hole 45 sized to receive a means of attaching to the carriage 22, such as a post or pin 46. In FIGS. 2 and 3, carriage support member 40 is shown next to carriage 22 rather than pivotably attached to carriage 22, so the hole 45 and the post 46 can be clearly seen. The length of bar shaped structure 41, can be longer than or shorter than carriage 22. The length of bar shaped structure 41 is typically slightly longer than the distance between first contact area 42 and second contact area 43. In one embodiment of the invention, the post 46 is inserted into the hole 45 with a clearance such that the bar shaped structure 41 can pivot relative to the carriage 22. Alternately, the carriage attachment 44 can include a pin or post to be inserted into a hole on the carriage 22. Similarly, the bar shaped structure 41 can pivot relative to the carriage 22.

The first contact area 42 and the second contact area 43 slide along the secondary guide rail 35 during printing. The first contact area 42 and the second contact area 43 are in contact at a first contact point 42*a* and a second contact point 43*b* on the secondary guide rail 35, as shown in FIG. 3. The first contact point 42*a* is defined as the area on the secondary guide rail 35 momentarily touching the first contact area 42 as the carriage 22 moves along the secondary guide rail 35. Similarly the second contact point 43*a* is defined as the area on the secondary guide rail 35 momentarily touching the second contact area 43. In this example, the support member 40 is biased against the surface of the secondary guide rail 35 by the weight of the carriage 22 (as the center of mass of the carriage 22 is not positioned directly above the primary guide rail 30) such that the support member 40 remains in contact with the secondary guide rail 35. Alternatively in other embodiments, the carriage support 40 can be biased against secondary guide surface 35 by a spring or other means. All of the support members disclosed in this invention remain in contact with the secondary guide rail in at least one contact point using this technique.

As the carriage 22 moves over the media in a direction shown by bi-directional arrow 32 along the primary guide rail 30 and the secondary guide rail 35, the support member 40 is in contact with the secondary guide rail 35 and moves along with the carriage 22. The carriage 22 is attached to a belt that is driven with a motor. The carriage 22 also has an encoder sensor that reads an encoder strip that spans the length of the printing region of printer 10. Bi-directional movement of the carriage 22 is provided by the printer's firmware, control electronics, motor and belt.

The preferred overall length of the bar shaped structure 41 is dependent on the defect to be addressed. The distance between the first contact area 42 and the second contact area 43 is designed to accommodate a known type of defect and a size of defect along the secondary guide rail 35.

Figure 4:
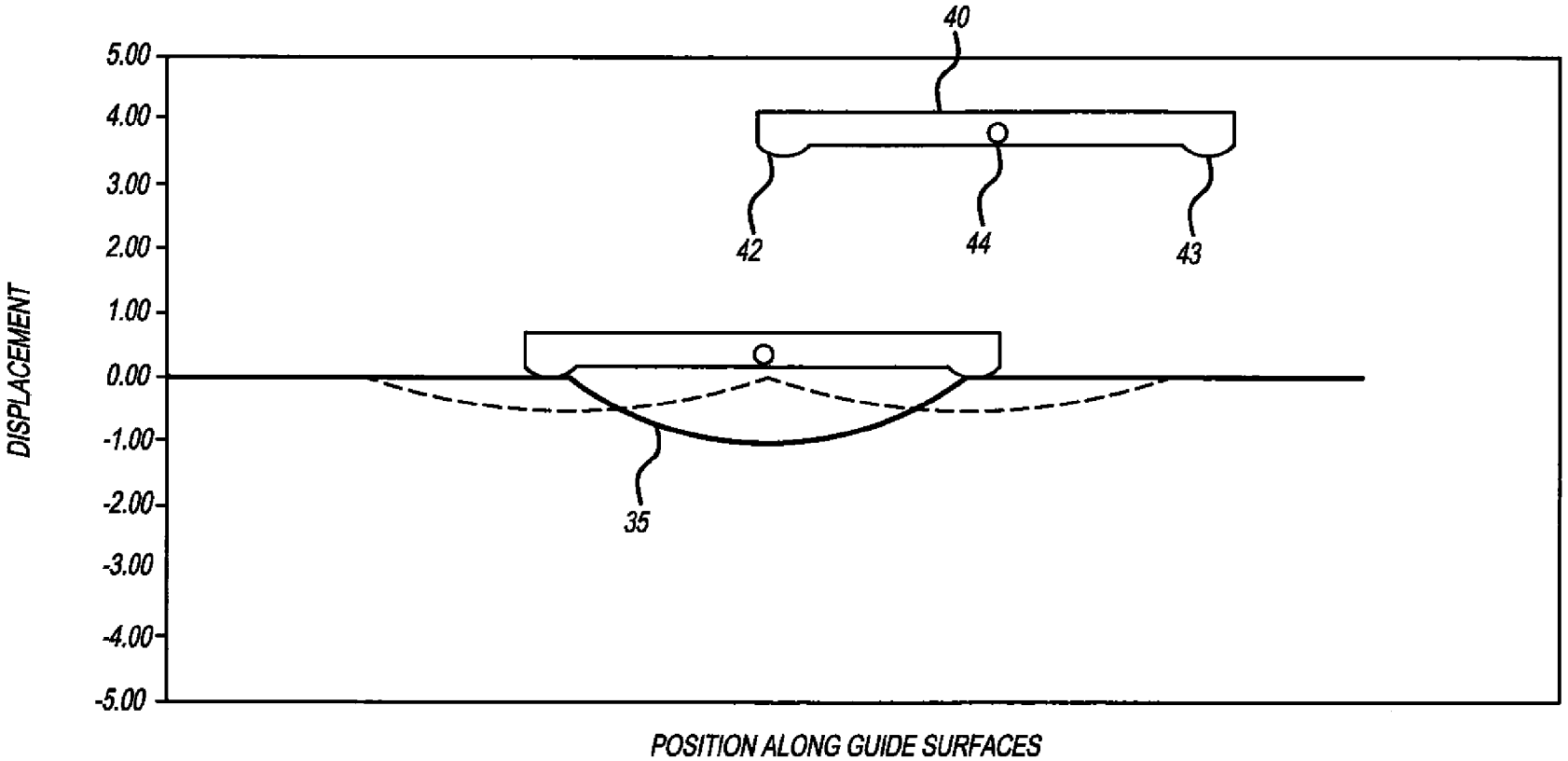
FIG. 4 is a graphical illustration showing a single defect in the secondary guide rail. The graph shows the carriage position for contacts that are spaced more widely than the width of the defect.

To compensate for single or non-cyclic defects, the distance between the first contact area 42 and the second contact area 43 is preferably selected such that one contact area remains on a secondary guide rail 35 area without the defect, while the other contact area is on the defect area. In general this will favor a spacing between first contact area 42 and second contact area 43 that is wider than the length of a typical defect along the length of the secondary guide surface 35. FIG. 4 is a graphed example of a single defect. As shown in FIG. 4, if the secondary rail 35 defect is one unit high or deep, the motion transmitted to the carriage 22 would be half of a unit, not counting the scaling by S2/S1 discussed above. The shape of the dashed curve 31 representing the displacement of carriage attachment 44 can be understood as follows. When both contact areas 42 and 43 are outside the defect, carriage attachment 44 will have no displacement from the ideal straight line of travel. As one of the contacts 42 or 43 enters the defect region, carriage attachment 44 moves to the average between the position of contact 42 and the position of contact 43. When contact 42, for example, has not yet reached the defect, but contact 43 is at the deepest portion (1 unit) of the defect, carriage attachment 44 will be displaced by the average of 0 units and 1 unit, i.e. half a unit. FIG. 4 shows the case of the support member 40 where the contact areas 42 and 43 bridge over the defect, so that the displacement has returned to 0. As the support member 40 continues to travel along the secondary guide rail 35, contact area 42 enters the defect region, but contact area 43 is outside the defect region. While the carriage support member 40 may not compensate in whole for the non-cyclic defect, it can compensate in an amount of up to about 50% of the non-cyclic defect.

Figure 5:
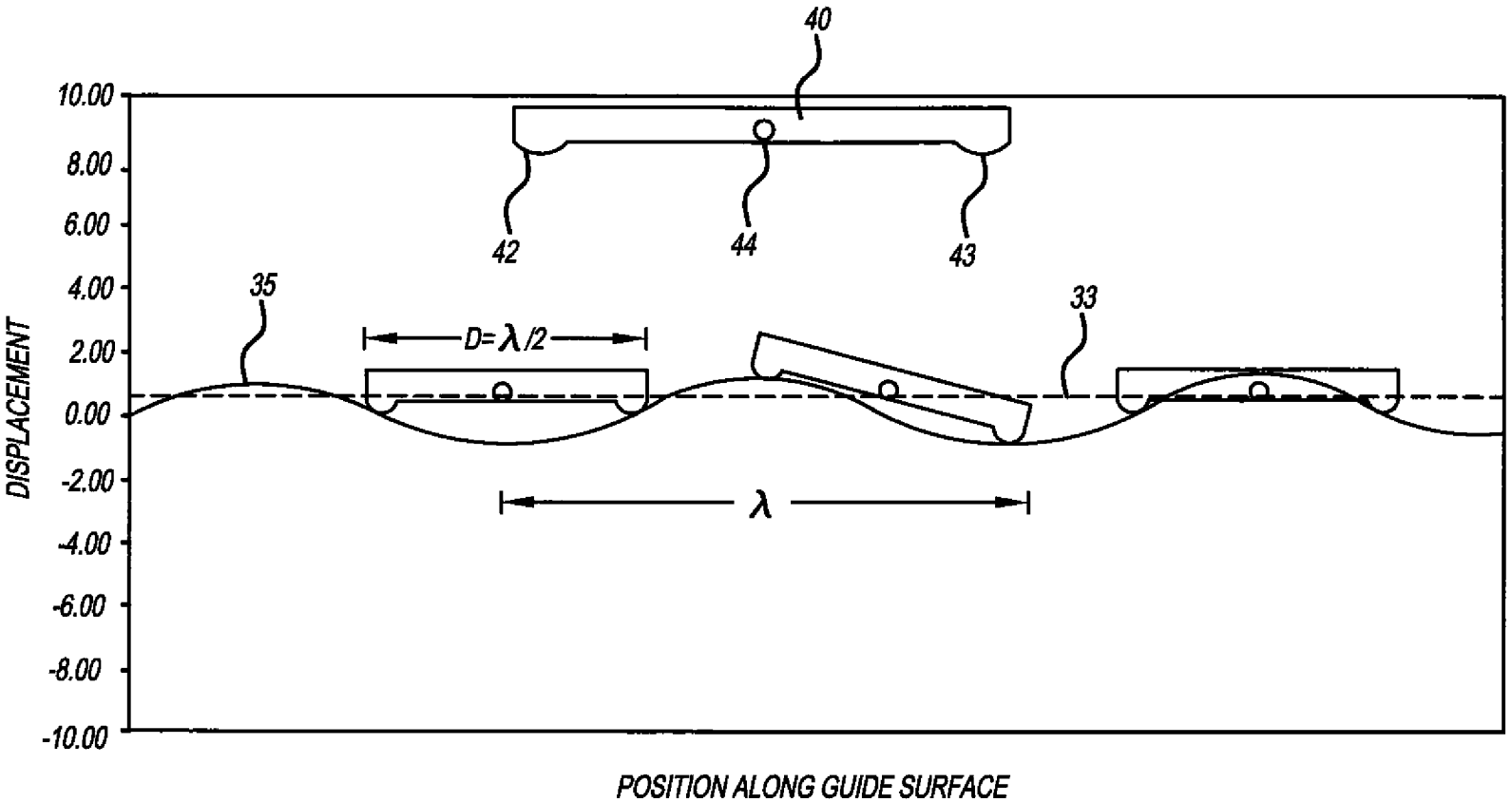
FIG. 5 is a graphical illustration of sinusoidal displacement of the secondary guide rail and the carriage position along a scan axis versus displacement.

Another example of a defect in the secondary guide surface 35 is a cyclic defect such as due to manufacturing variations or to mechanical fasteners 66 spaced at regular intervals $\lambda$ to attach the secondary guide rail 35 to the support structure 20. FIG. 5 is a graphed example of when the secondary guide rail has a cyclic defect. The preferred contact separation distance between the first contact area 42 and the second contact area 43 is half the wavelength (i.e. $\lambda/2$) of the cyclic defect. This would result in zero displacement transmitted to the carriage 22, as shown in FIG. 5. In other words, the carriage attachment 44 would continue to move along the desired straight path 33, while the first and second contact areas ride up and down the cyclically varying secondary guide rail surface 35. The orientation of bar shaped structure 41 does not matter as the carriage 22 travels across the wavy surface of the secondary guide rail 35. What matters is that the carriage attachment 44 remains along straight path 33. More generally, a separation distance D between the first contact area 42 and the second contact area 43 can be forty percent to sixty percent of the wavelength $\lambda$ of the secondary rail 35 defect. A possible motivation for designing the separation D to be slightly different from $\lambda/2$ is if there are vibration problems, such as resonances, transmitted to carriage 22 by the pivoting support member 40 as it travels along the secondary guide rail 35. If the cyclic variation has a peak to peak wavelength $\lambda$, the variation straightness can be completely compensated by designing the distance D between the two contact areas to be $\lambda/2$. More generally, a distance D can be any odd integral number of half wavelengths, i.e. $D=(2n+1)\lambda/2$, but distances D which range between 80% and 120% of these preferred values will also provide much of the desired compensation against waviness in the secondary guide surface. Unless $\lambda$ is shorter than about 20 mm (for example in a wide format printer), or the secondary guide surface is very long, typically n will be 0 or an integer between 1 and 5. The longer that D is, the longer that the secondary guide surface 35 needs to be relative to the range of travel of carriage 22. For example, where the mechanical fasteners on the secondary rail 35 cause a cyclic defect every 100 mm, then a preferred distance D would be 50 mm (i.e. $\lambda/2$) between the contact areas, but a range of distances D between 40 mm and 60 mm would still provide much of the compensation for waviness in the secondary guide surface. Typically the length of the bar would be slightly longer than D. In another embodiment wherein the mechanical fasteners are the same 100 mm apart, a second preferred distance D can be 150 mm (i.e. $3\lambda/2$) between the contact areas. Similarly a third preferred distance D for the example of mechanical fasteners every 100 mm apart would be $5\lambda/2$ or 250 mm. The spaced apart first and second contact areas 42, 43 aid in compensating for variations in straightness along the secondary guide rail 35. Where a repetitive defect is not spaced at a set recurring distance, such as where the mechanical fasteners 66 are not evenly spaced on the support structure 20, then the separation distance between the first contact area 42 and the second contact area 43 can be chosen to be half the average wavelength of the cyclic defect. The distance D between the contact areas is determined using the same technique for all embodiments of the carriage support structures disclosed.

For example, the distance D between the first contact area 42 and the second contact area 43 can range from about 60 to 90 mm in a wide format inkjet ink printer having mechanical fasteners 66 every 150 mm. Again the distance D between the first contact area 42 and a second contact area 43 can vary based on the style of the imaging apparatus and the periodicity of the cyclic defect.

Figure 6:
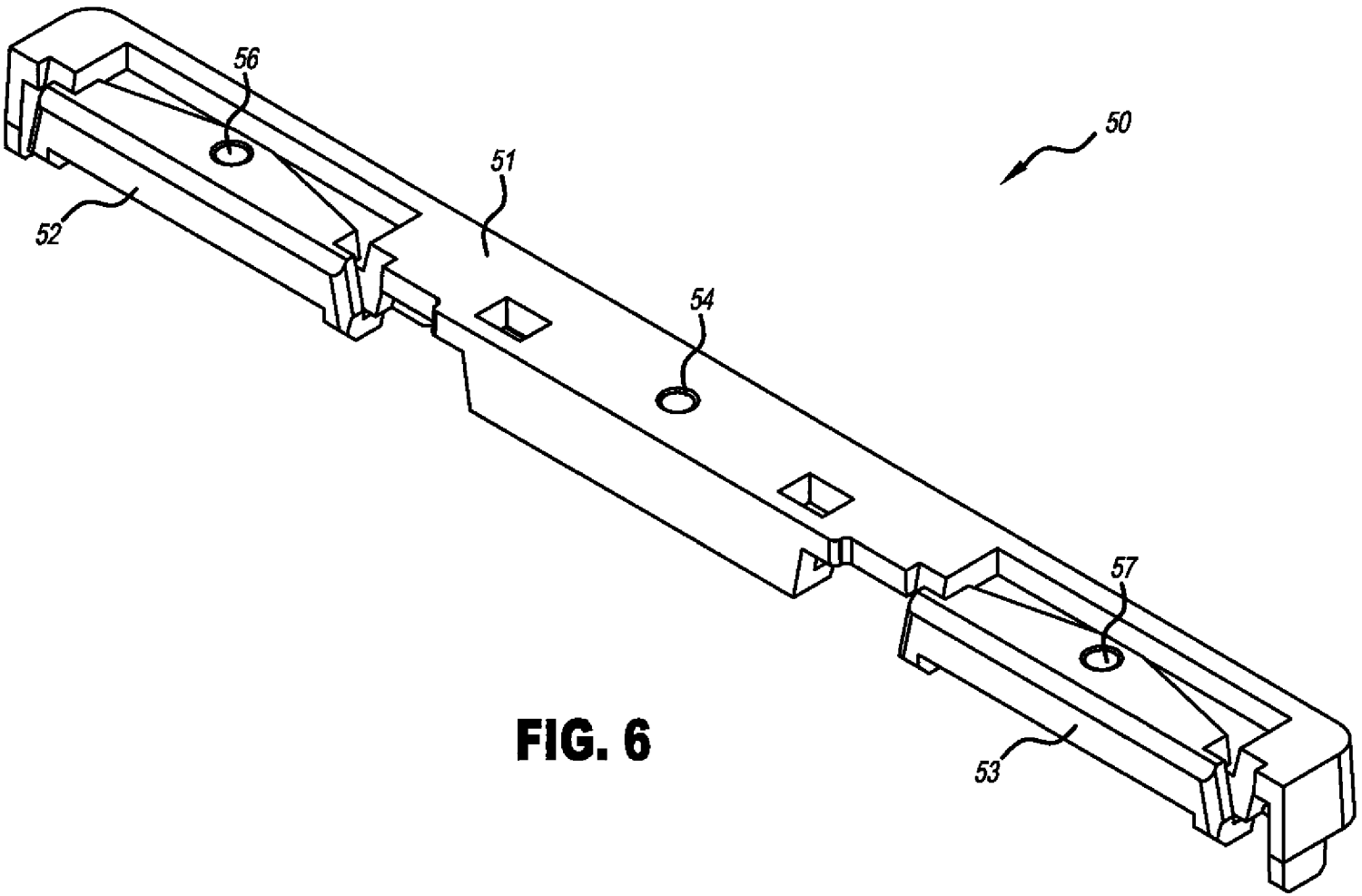
FIG. 6 is a perspective view of a second embodiment of the carriage support member.

A second embodiment of the carriage support structure is shown in FIG. 6. A carriage support member 50 for supporting and guiding a carriage 22 is shown. The carriage support member 50 includes a bar shaped structure 51 with a first pivotable flat surface 52 and a second pivotable flat surface 53. A carriage pivot attachment 54 is positioned between the first pivot area 52 and the second pivot area 53. Thus the carriage support member 50 itself pivots and has at two extended areas of slidable contact 52, 53 with the secondary guide rail 35. As shown in FIG. 6, the first and second pivotable flat surfaces 52, 53 are located within the bar shaped structure 51. The first pivotable flat surface 52 and the second pivotable flat surface 53 pivot independently of each other along the secondary guide rail 35. The carriage pivot attachment 54 has the same structure and function as the carriage attachment 44 described in FIG. 3. The bar shaped structure 51 is pivotable about the carriage pivot attachment 54. The carriage 22 attaches to the carriage pivot attachment 54 on the bar shaped structure 51 using, for example, the post or pin and hole attachment discussed above. Also, as described in the first embodiment, the preferred spacing of the first pivotable flat surface 52 and the second pivotable flat surface 53 is also determined by the known type and size of the defect in the secondary guide rail 35. While not being bound by theory, a possible motivation for the extended flat surfaces 52 and 53 is that they can bridge across narrow defects such as scratches and thereby be less affected than contact areas 42 and 43 of the first embodiment might be affected. The length of the extended flat surface in this embodiment can be about 10 to 20 mm, again based on a wide format inkjet ink printer having mechanical fasteners 66 every 150 mm. The ideal spacing between the pivot point 56 for the first pivotable flat surface 52 and the pivot point 57 for the second pivotable flat surface 53 is $D=(2n+1)\lambda/2$, as in the first embodiment, though it can vary from this ideal value somewhat.

During printing, as the carriage 22 moves along the media, the support member 50 being pivotably attached to the carriage 22, slides along the secondary guide rail 35 with the carriage 22 to provide adequate spacing between the printheads 26 on the carriage 22 and the media. As the support member 50 slides along the secondary guide rail 35, the first pivot area 52 and second pivot area 53 pivot about their pivot points 56 and 57 as they encounter variations in the surface of the secondary guide rail 35. Also, the bar shaped structure 51 pivots about the carriage pivot attachment 54. This embodiment can provide better wear resistance than the first embodiment as it moves along the secondary rail.

Figure 7:
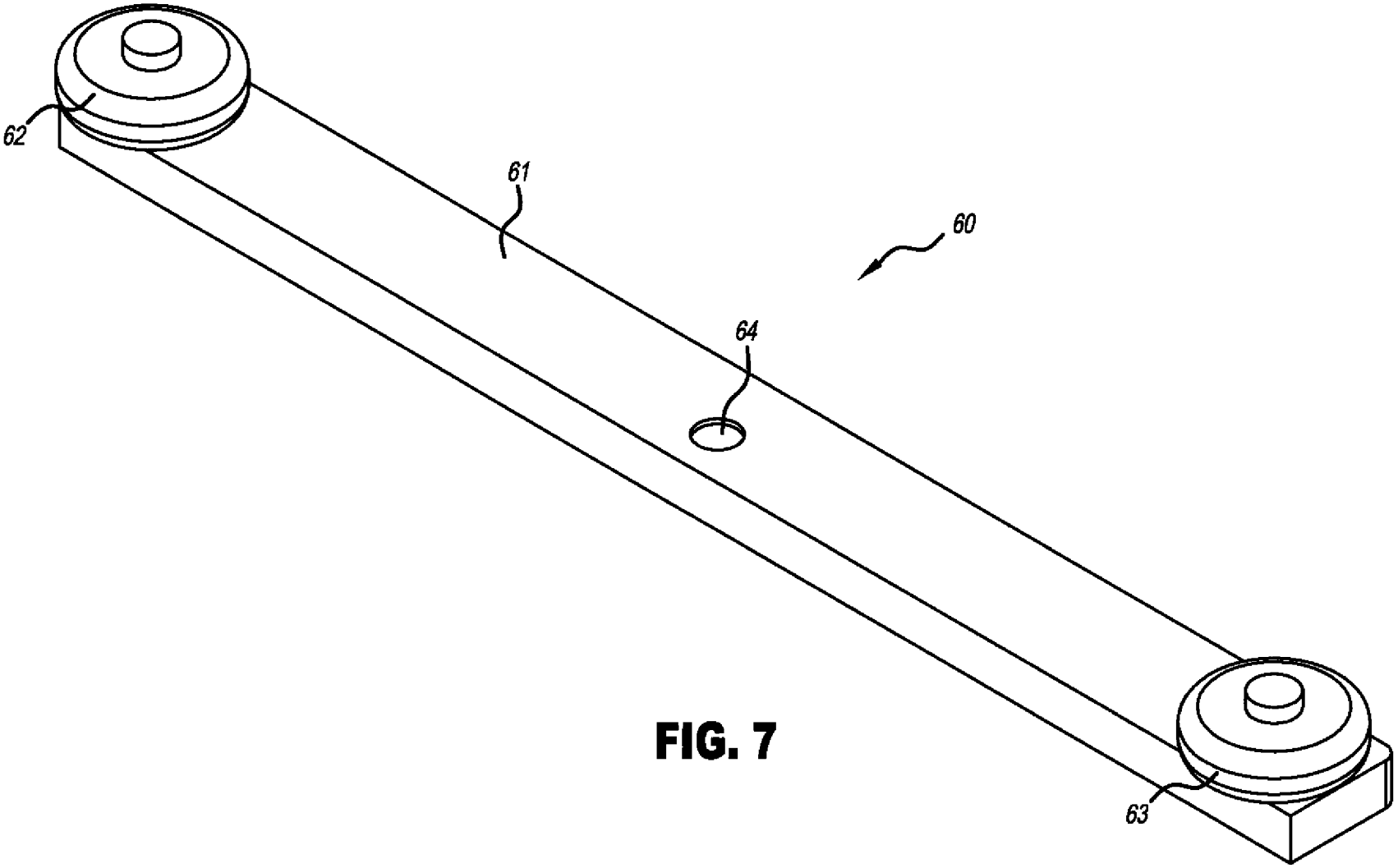
FIG. 7 is a perspective view of a third embodiment of the carriage support member

A third embodiment of the carriage support member 60 is shown in FIG. 7. A carriage support member 60 for supporting a carriage 22 is shown. The carriage support member 60 includes a bar shaped structure 61 with a first contact roller 62 and a second contact roller 63. A carriage pivot attachment 64 is positioned between the first contact roller 62 and the second contact roller 63. The first contact roller 62 and the second contact roller 63 make contact with the secondary guide rail 35 and roll along the secondary guide rail 35. The carriage pivot attachment structure 64 has the same structure and function as the carriage attachment structures described above. The first contact roller 62 and the second contact roller 63 rotate around their respective axes. The rollers 62 and 63 rotate in both a clockwise and counter clockwise direction along the secondary guide rail 35 as the carriage 22 traverses bi-directionally about the print media. The rollers 62 and 63 can provide less friction and better wear resistance than the sliding contact areas in the other embodiments. Preferably, the first contact roller 62 and the second contact roller 63 are pressed or small clearance fit on a shaft on the top surface of the bar shaped structure 61. The rollers 62 and 63 can be of any material, such as plastics and metals. The ideal spacing between the shaft of the first contact roller 62 and the shaft of the second contact roller 63 is $D=(2n+1)\lambda/2$, as in the first embodiment, though it can vary from this ideal value somewhat.

During printing, the bar shaped structure 61 pivots about the carriage pivot attachment 64 as the first contact roller 62 and the second contact roller 63 rotate about their respective axes (or shafts).

FIG. 8 is a side view of the carriage 22 and the primary guide rail 30 and the secondary guide rail 35 and a carriage support member 40 in an inkjet printer 10. For illustration purposes, the first embodiment of the carriage support member 40 is shown. However, a second embodiment of the carriage support member 50 or the third embodiment of the carriage support member 60 would be positioned in the same location and distance as the carriage support member 40 based on the cyclic defects defined above. In the example shown in FIGS. 8 and 9, the carriage 22 supports three staggered printheads 26 as they traverse along the print media. The carriage moves along the primary guide rail 30 (in and out of the drawing in FIG. 8). As the carriage 22 moves along the media, the carriage support member's 40 first contact area 42 and second contact area 43 make contact with the secondary guide rail 35 at a first contact point where the first contact area 42 makes contact with the secondary guide rail 35 and a second contact point where the second contact area 43 makes contact with the secondary guide rail 35. FIG. 9 is a top view of the carriage 22 and the second embodiment of the carriage support member 50 along the secondary guide rail 35 in an inkjet printer 10. The carriage 22 is attached to the bar shaped structure 51 at the carriage attachment 54. The mechanical fasteners 66 where the secondary rail 35 is attached to the support structure 20 are shown. As described above, the first flat surface 52 and the second flat surface 53 pivot about their respective pivot points.

In the embodiments discussed above, the spacing D between contact areas, or pivot points, or roller shafts has been assumed to be constant, having been designed to accommodate typical defects found to be characteristic of secondary guide rails of a particular type, geometry, and mounting configuration. However, it is also contemplated that support member 40 can have an adjustable length provided, for example, by one section telescoping into another, so that the spacing D can be custom adjusted for a particular secondary guide rail 35 in a particular inkjet printer 10.

All embodiments of the invention can be used in various imaging apparatus such as image forming devices and image reading devices.

The invention has been described in detail with particular reference to certain preferred embodiments thereof, but it will be understood that variations and modifications can be effected within the scope of the invention.

PARTS LIST

10—Inkjet printer
11—Right side Housing
12—Left side Housing
14—Legs
36—Ink reservoirs
26—Inkjet Printheads
38—Plastic conduits or tubing
18—Platen
20—Support structure
22—Print carriage
24—Inkjet printhead holders
30—Primary guide rail or shaft
35—Secondary guide rail
32—Bi-directional arrow
33—Desired straight path
31—Displacement for single defect and widely spaced contacts
40—Carriage support member of first embodiment
41—Bar shaped structure of first embodiment
42—First contact area of first embodiment
43—Second contact area of first embodiment
44—Carriage attachment of first embodiment
45—Hole
46—Post
**42*a***—First contact point
**43*b***—Second contact point
**39*a*, 39*b***—Bushings or primary support members
D—Separation distance
50—Carriage support member of second embodiment
51—Bar shaped structure of second embodiment
52—First pivotable flat surface of second embodiment
53—Second pivotable flat surface of second embodiment
54—Carriage pivot attachment of second embodiment
56—Pivot point for first pivotable flat surface
57—Pivot point for second pivotable flat surface
60—Carriage support member of third embodiment
61—Bar shaped structure of third embodiment
62—First contact roller of third embodiment
63—Second contact roller of third embodiment
64—Carriage pivot attachment of third embodiment
66—Mechanical fasteners

The invention claimed is:

1. A carriage support member for supporting a carriage that moves along a primary guide rail and a secondary guide surface including a length, the carriage support member comprising:

a bar shaped structure including a surface, distinct and spaced apart portions of the surface defining a first contact area and a second contact area, both of the first contact area and the second contact area protruding beyond an intermediate portion of the same surface located between the first contact area and the second contact area, the first contact area and the second contact area being in contact with the secondary guide surface, the intermediate portion of the same surface not being in contact with the secondary guide surface, the first contact area being spaced apart from the second contact area in a direction that is parallel to the length of the secondary guide surface; and a pivotable carriage attachment located between the first contact area and the second contact area of the bar shaped structure.

2. The carriage support member of claim 1, wherein the first contact area and the second contact area are capable of sliding contact along the secondary guide surface.

3. The carriage support member of claim 1, wherein the first contact area and the second contact area are rollers which move along the secondary guide surface.

4. The carriage support member of claim 1, wherein at least one of the first contact area and the second contact area is pivotable relative to the bar shaped structure.

5. The carriage support member of claim 1, wherein a distance between the first contact area and the second contact area is between 40 mm and 250 mm.

6. The carriage support member of claim 1, wherein a distance between the first contact area and the second contact area is adjustable.

7. The carriage support member of claim 1, wherein the secondary guide surface includes a periodic curvature with alternating peaks and valleys, the periodic curvature defining an average wavelength, the carriage support member being configured such that the first contact area and the second contact area are spaced apart from each other by at least an odd integral number times forty percent of the average wavelength and at most the odd integral number times 60 percent of the average wavelength.

8. The carriage support member of claim 1, wherein the carriage is a printhead carriage that is attached to the pivotable carriage attachment.

9. An imaging apparatus comprising a primary guide rail;

a secondary guide surface including a length; and a carriage support member that supports an imaging apparatus carriage, the imaging apparatus carriage being moveable along the primary guide rail and the secondary guide surface, the carriage support member including:

a bar shaped structure including a surface, distinct and spaced apart portions of the surface defining a first contact area and a second contact area, both of the first contact area and the second contact area protruding beyond an intermediate portion of the same surface located between the first contact area and the second contact area, the first contact area and the second contact area being in contact with the secondary guide surface, the intermediate portion of the same surface not being in contact with the secondary guide surface, the second contact area being spaced apart from the first contact area in a direction that is parallel to the length of the secondary guide surface; and a pivotable carriage attachment located between the first contact area and the second contact area of the bar shaped structure.

10. The imaging apparatus of claim 9, wherein the first contact area and the second contact area are rollers which move along the secondary guide surface.

11. The imaging apparatus of claim 9, wherein at least one of the first contact area and the second contact area is pivotable relative to the bar shaped structure.

12. The imaging apparatus of claim 9, wherein a distance between the first contact area and the second contact area is between 40 mm and 250 mm.

13. The imaging apparatus of claim 9, wherein a distance between the first contact area and the second contact area is adjustable.

14. The imaging apparatus of claim 9, wherein the secondary guide surface includes a periodic curvature with alternating peaks and valleys, the periodic curvature defining an average wavelength, the bar shaped structure being configured such that the first contact area and the second contact area are spaced apart from each other by at least an odd integral number times forty percent of the average wavelength and at most the odd integral number times 60 percent of the average wavelength.

* * * * *